US009647349B1

(12) United States Patent
Stillman

(10) Patent No.: US 9,647,349 B1
(45) Date of Patent: May 9, 2017

(54) THROUGH-INSULATION STRIP LIGHT CONNECTOR

(71) Applicant: Elemental LED, Inc., Emeryville, CA (US)

(72) Inventor: James Stillman, Shenzhen (CN)

(73) Assignee: Elemental LED, Inc., Emeryville, CA (US)

( * ) Notice: Subject to any disclaimer, the term of this patent is extended or adjusted under 35 U.S.C. 154(b) by 0 days.

(21) Appl. No.: 15/202,199

(22) Filed: Jul. 5, 2016

Related U.S. Application Data

(60) Provisional application No. 62/344,742, filed on Jun. 2, 2016.

(51) Int. Cl.

| | |
|---|---|
| ***H01R 4/24*** | (2006.01) |
| ***F21V 23/06*** | (2006.01) |
| ***F21S 4/28*** | (2016.01) |
| ***H01R 13/52*** | (2006.01) |

(52) U.S. Cl.
CPC ..... *H01R 4/2445* (2013.01); *F21S 4/28* (2016.01); *F21V 23/06* (2013.01); *H01R 4/2404* (2013.01); *H01R 13/5202* (2013.01); *H01R 13/5216* (2013.01)

(58) Field of Classification Search
CPC .. H01R 4/2433; H01R 4/2404; H01R 4/2429; H01R 13/506; H01R 9/0757; H01R 23/005; H01R 2201/16; H01R 4/2491; H01R 12/67
USPC ..... 439/417, 404, 405, 409, 411, 393
See application file for complete search history.

(56) References Cited

U.S. PATENT DOCUMENTS

| | | | | |
|---|---|---|---|---|
| 3,670,290 | A | 6/1972 | Angele et al. | |
| 3,702,982 | A * | 11/1972 | Kelly | H01R 43/00 439/418 |
| 4,632,486 | A * | 12/1986 | Hasircoglu | H01R 12/598 439/394 |
| 4,657,329 | A * | 4/1987 | Dechelette | H01R 12/67 439/404 |
| 4,768,969 | A | 9/1988 | Bauer et al. | |
| 4,932,895 | A * | 6/1990 | van de Kerkhof | H01R 12/675 439/417 |
| 4,952,177 | A | 8/1990 | Drake et al. | |
| 5,064,382 | A * | 11/1991 | Minnis | H01R 23/667 102/200 |
| 5,121,310 | A * | 6/1992 | Ahroni | F21V 21/002 362/238 |
| 5,391,088 | A * | 2/1995 | Tomchak | H01R 25/162 439/216 |
| 5,499,930 | A * | 3/1996 | Cieri | H01R 12/67 439/374 |

(Continued)

*Primary Examiner* — Abdullah Riyami
*Assistant Examiner* — Vladimir Imas
(74) *Attorney, Agent, or Firm* — PatentBest; Andrew McAleavey

(57) ABSTRACT

A connector for light-emitting diode (LED) strip light is disclosed. The connector has a cavity with conductive longitudinal and transverse pins that, when the connector is assembled with an LED strip light in a cavity within the housing of the connector, penetrate the insulation of the strip light to make electrical contact with the strip light's conductors. The connector also includes gasket seals and a removable portion that exposes the cavity. The removable portion may include a window to expose any LEDs that may be within the housing of the connector.

16 Claims, 5 Drawing Sheets

(56) References Cited

U.S. PATENT DOCUMENTS 5,559,681 A * 9/1996 Duarte ..... F21V 21/08 362/231
6,283,612 B1 9/2001 Hunter
6,375,490 B1 * 4/2002 Yao ..... H01R 12/79 439/261
6,551,124 B1 * 4/2003 Gossmann ..... H01R 13/5219 439/411
6,648,672 B1 * 11/2003 Meinke ..... H01R 4/2433 439/380
6,657,381 B1 * 12/2003 Arutaki ..... G09F 9/33 313/512
6,660,935 B2 * 12/2003 Southard ..... G09F 9/33 174/50
6,734,358 B2 * 5/2004 Denne ..... B60R 16/0215 174/101
6,837,598 B2 * 1/2005 Marcus ..... F21S 8/032 362/235
7,114,841 B2 * 10/2006 Aanegola ..... F21V 21/002 362/249.02
7,160,140 B1 * 1/2007 Mrakovich ..... F21V 21/002 439/417
7,175,303 B2 2/2007 Kovacik et al.
7,207,523 B2 * 4/2007 Callahan ..... B60R 16/0207 174/10
7,273,389 B2 * 9/2007 Hoppach ..... H01R 4/2404 439/275
7,338,310 B2 * 3/2008 Kumakura ..... H01R 12/68 439/422
7,370,831 B2 * 5/2008 Laib ..... B64C 1/18 174/70 B
7,473,006 B1 1/2009 Bollman
8,128,427 B2 * 3/2012 Mochizuki ..... F21S 48/212 439/419
8,231,261 B2 7/2012 Gherardini et al.
8,648,735 B2 * 2/2014 Haynes ..... G08G 1/09 119/859
8,714,772 B1 * 5/2014 Levante ..... F21V 23/06 362/217.17
8,814,590 B2 * 8/2014 Turco ..... F21V 21/002 439/419
8,834,197 B2 * 9/2014 Wu ..... H01R 23/005 439/497
8,979,296 B2 3/2015 Wiemer et al.
9,206,964 B2 12/2015 Marsh et al.
9,374,856 B2 6/2016 Winton
2002/0106931 A1 8/2002 Hsien-Te
2003/0063463 A1 * 4/2003 Sloan ..... F21V 21/0808 362/238
2008/0137377 A1 * 6/2008 Brengartner ..... F21V 21/002 362/640
2010/0008090 A1 * 1/2010 Li ..... F21V 17/007 362/249.03
2012/0002417 A1 1/2012 Li
2013/0249394 A1 9/2013 Fay
2015/0077998 A1 3/2015 Zhang
2015/0241035 A1 8/2015 Dankelmann et al.
2015/0285472 A1 10/2015 Evitt

* cited by examiner

THROUGH-INSULATION STRIP LIGHT CONNECTOR

CROSS-REFERENCE TO RELATED APPLICATIONS

This application claims priority to U.S. Provisional Patent Application No. 62/344,742, filed Jun. 2, 2016, the contents of which are incorporated by reference in their entirety.

BACKGROUND OF THE INVENTION

1. Field of the Invention

In general, the invention relates to electrical connectors, and more particularly, to electrical connectors for light-emitting diode (LED) strip lights.

2. Description of Related Art

Over the last decade, light-emitting diode (LED)-based lighting has become popular in both residential and commercial lighting applications because of its efficiency, adaptability, and wide range of color and color temperature options. One of the most popular forms of LED light is the strip light—a long, flexible printed circuit board (PCB) with LED light engines connected to the PCB at a regular interval along its length. Strip light can be placed in long extrusions to provide the same sort of form factor that a traditional fluorescent or incandescent fixture might and has a plethora of other uses. Backed by adhesive, strip light can adhere to essentially any surface, and is sometimes referred to as tape light.

Strip light typically experiences a voltage drop per unit length, which limits its maximum length. In order to overcome that voltage drop, strip light can be made to operate at higher voltages. For example, a 12V strip light might have a maximum effective length of about 16 feet (4.9 meters), while a 24V strip light might have a maximum effective length of about 40 feet (12.2 meters). The use of low voltage—depending on the authority one consults, anything under about 50 V—is advantageous because it poses less of a safety hazard and is less strictly regulated under electrical and fire codes and regulations.

Higher-voltage strip light is available on the market, and has significant advantages in terms of maximum length. For example, a strip light operating at 120V may have a maximum effective length on the order of 150 feet (45.7 meters). For this type of high-voltage strip light, a pair of wires run the entire length of the PCB, usually one wire positioned on each side of the PCB, to provide power. The wires are connected to the PCB at intervals, essentially connecting segments of the PCB in parallel with one another. The entire PCB and its power-conducting wires are typically coated or wrapped in a transparent or translucent insulative and waterproof coating, e.g., made of vinyl or another appropriate material.

Making electrical connections to strip light typically involves soldering wires to the strip light or connecting the existing wires with mechanical crimps. These processes include a number of delicate steps and may require extra equipment to perform. Especially when soldering is necessary, it can be difficult to ensure that a good connection has been made. Moreover, because most strip light is designed to be cut to desired lengths in the field, connections are often made under less-than-ideal conditions by installers whose training and ability can vary greatly. A more robust and reliable solution for connecting strip light to power would be useful.

SUMMARY OF THE INVENTION

One aspect of the invention relates to a through-insulation strip light connector. A connector housing includes a cavity sized to accept the cut or free end of a light-emitting diode (LED) strip light. The cavity includes two or more sets of pins arranged in different orientations from one another that extend upward from the floor of the cavity and are sharpened and otherwise adapted to penetrate the insulation of the strip light to make electrical contact with its conductors when the strip light is fully installed in the housing. The sets of pins each include a transverse pair of pins positioned to cradle the conductor and make electrical contact in a first orientation and location and a longitudinal group of pins positioned to make electrical contact in a second orientation and direction. The sets of pins are contiguous parts of a pair of strip conductors disposed beneath the floor of the cavity. The hidden ends of the strip conductors are arranged and adapted to make electrical contact with power conductors from a power cable. A removable portion of the housing that is placed overtop the strip light may include a window to allow the last LED or LEDs on the strip light to be seen. The through-insulation strip light connector thus provides a robust, redundant electrical connection with a strip light without the need to solder or place connectors on wire.

Other aspects, features, and advantages of the invention will be set forth in the description that follows.

BRIEF DESCRIPTION OF THE DRAWING FIGURES

The invention will be described with respect to the following drawing figures, in which like numerals represent like features throughout the description, and in which.

DETAILED DESCRIPTION

Figure 1:
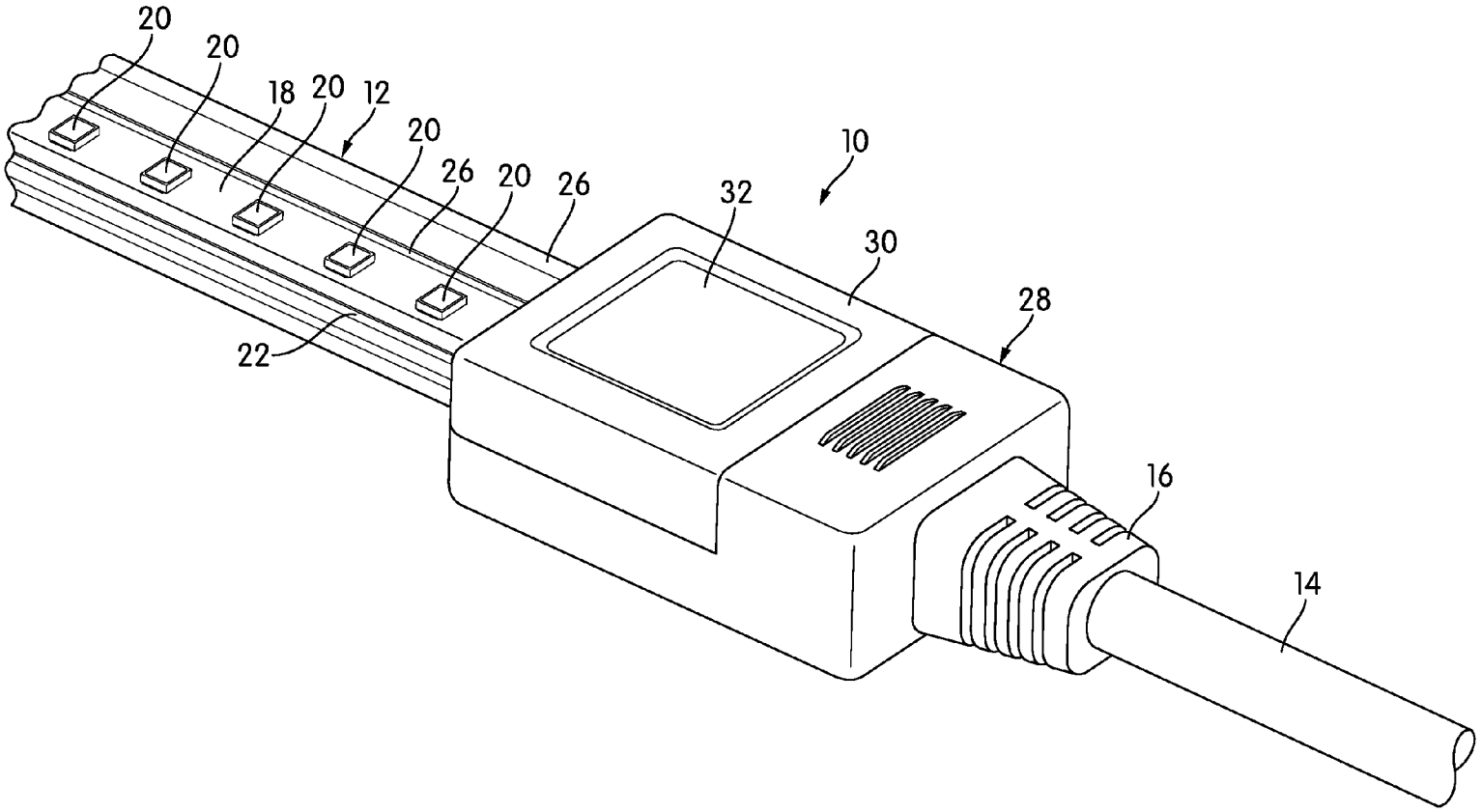
FIG. 1 is a perspective view of a power connector assembly according to one embodiment of the invention, shown with a strip light installed.

FIG. 1 is a perspective view of a connector, generally indicated at 10, that connects a strip light 12 with a traditional power cable 14. The connector 10 includes molded strain relief 16 where the cable 14 meets the connector 10.

The strip light 12 itself comprises a printed circuit board (PCB) 18 on which light-emitting diode (LED) light engines 20 are disposed at a regular interval. The interval is usually constant over the entire length of the strip light, but may vary in some cases. The PCB may include other circuits, including LED driver circuits, and it may be either flexible or rigid. A flexible PCB may, for example, use mylar as a basic substrate, while a rigid PCB may use a material such as FR4 glass-fiber composite. In addition to the PCB 18 and the LEDs 20, the strip light has a pair of power conductors 22, 24, typically braided wires, that extend along its length, periodically connecting to the PCB 18 to provide power. The conductors 22, 24 themselves are usually without their own electrical insulation; the entire strip light 12 is enclosed in a transparent or translucent electrically insulating covering 26, such as a vinyl polymer.

Externally, the connector 10 has a housing 28 that, in the illustrated embodiment, is generally rectilinear in shape. The housing 28 would typically be made of a plastic, such as ABS plastic, although other materials may also be used. The housing 28 has a removable portion 30 that extends along its top and along portions of the left, right, and forward sidewalls of the housing 28. The housing 28 and its removable portion 30 may be specifically adapted for the strip light 12; in the illustrated embodiment, the removable portion 30 has a window in its top surface. The window 32 allows light from the last LED or LEDs 20 on the PCB 18 to be seen, and in some embodiments and installations, may prevent "dark spots" or breaks in the light generated by the strip light 12. The window 32 may be defined by a transparent or translucent material, such as glass or plastic, or it may simply be open.

Figure 2:
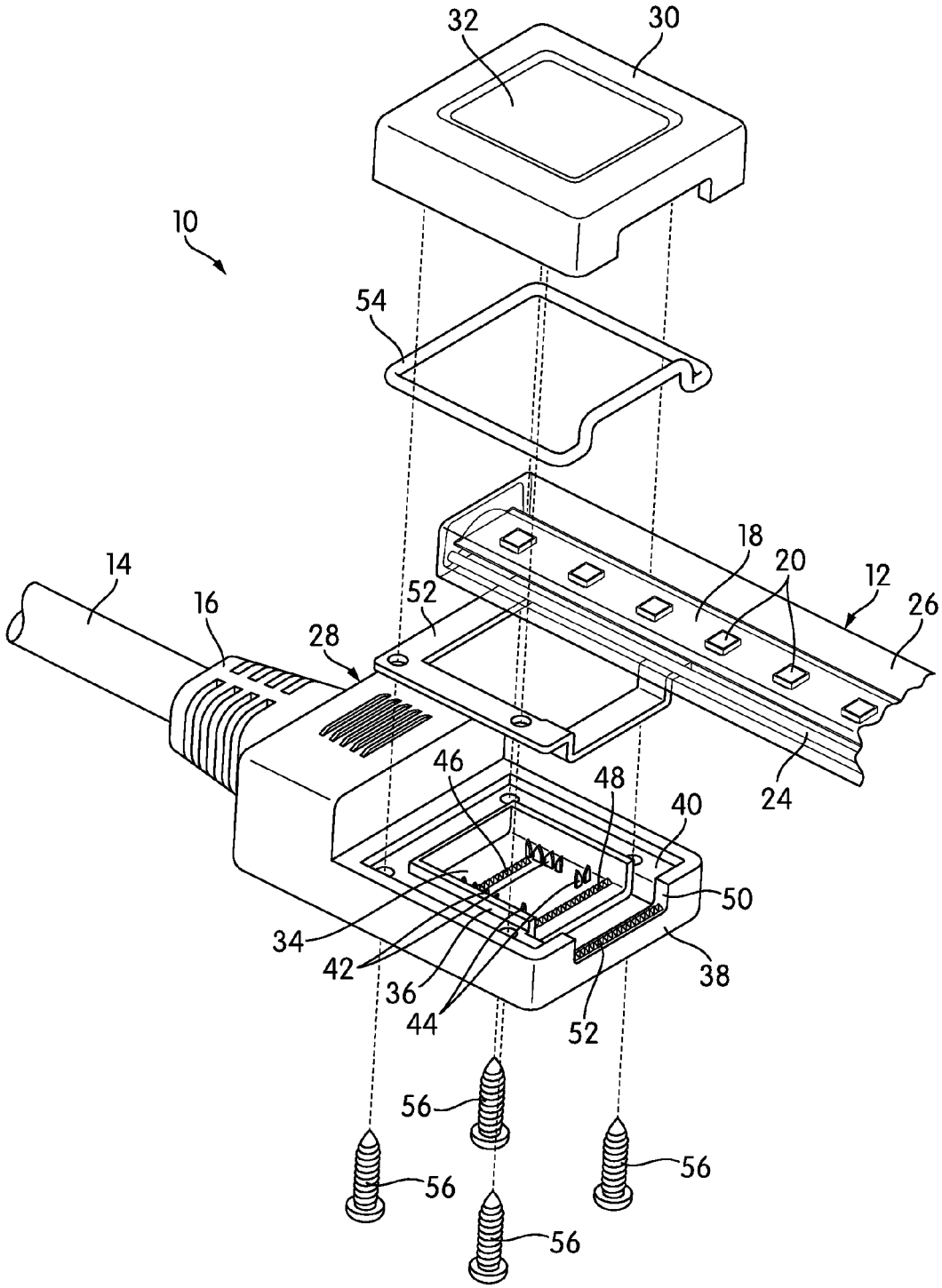
FIG. 2 is an exploded perspective view of the assembly of FIG. 1.

FIG. 2 is an exploded view of the connector 10 of FIG. 1. As shown, the housing has a depressed cavity 34 surrounded on three sides by a raised wall 36. Both the cavity 34 and the wall 36 are open toward the forward sidewall 38 of the housing 28, as is the housing 28 itself. Abutting the wall 36 around its perimeter and extending out from it is a recessed channel 40.

On the floor of the cavity 34 are a number of electrical contact and retaining features. Two sets of conductive longitudinal pins 42, one on each side of the cavity 34, extend upward from the floor of the cavity 34 and are parallel to the long axis of the housing 38. Two sets of conductive transverse pins 44, one on each side of the cavity 34, also extend upward from the floor of the cavity 34. Thus, one set of longitudinal pins 42 and one set of transverse pins 44 lie close to each other on each side of the cavity 34. Relative to the locations of the longitudinal pins 42 in each grouping, the transverse pins 44 in the illustrated embodiment are closer to the forward sidewall 38 of the housing 28. The transverse pins 44 are also orthogonal in orientation relative to the longitudinal pins 42.

In addition to the pins, 42, 44, the floor of the cavity 34 also has several rows of teeth 46, 48. The forward sidewall 38 of the housing 28 defines an opening 50, the floor of which also includes a row of teeth 52. The purpose of the pins 42, 44 and teeth 46, 48, 52 will be explained below in more detail.

A lower seal 52 is contoured to rest in the recessed channel 40, and has a thickness about equal to the depth of the channel 40 and contours that cause it to dip into and rest on the floor of the opening 50 and its teeth 52 as well. The lower seal 52 would typically be made of a resilient, water-resistant material, such as a silicone polymer. The strip light 12 is placed overtop the lower seal 52, such that it rests on the floor of the cavity 34 and extends out the opening 50. The resting position of the strip light 12 within the housing 28 is defined and delineated by the cavity 34 and the wall 36 around it—that space is typically dimensioned to be just larger than the strip light 12 itself, so as to provide for a tight fit.

An upper seal 54 rests overtop the strip light 12. The shape of the upper seal 54 is similar to that of the lower seal 52, except that the upper seal 54 has a rounder, thinner cross-section and accommodates the upper half of the opening 50. The upper seal 54 may rest in a groove or depression defined in the underside of the removable portion 30 (not shown in FIG. 2). Fixing the entire housing together are fasteners 56, four screws in the illustrated embodiment, that extend through aligned holes defined in the various components. Of course, the manner of closure and fastening is not critical, and many variations are possible.

The cavity 34, wall 36, and opening 50 are dimensioned and adapted to place the strip light 12 in a known and relatively precise location relative to the housing 28. When the connector 10 is assembled with the strip light 12 present and the fasteners 56 are tightened, the housing 28 compresses the strip light 12 and causes the longitudinal and transverse pins 42, 44 to penetrate the relatively soft insulative covering 26 of the strip light 12. The resulting positioning of the components is shown in the schematic end-elevational view of FIG. 3, as well as in the longitudinal cross-section of FIG. 4.

Figure 3:
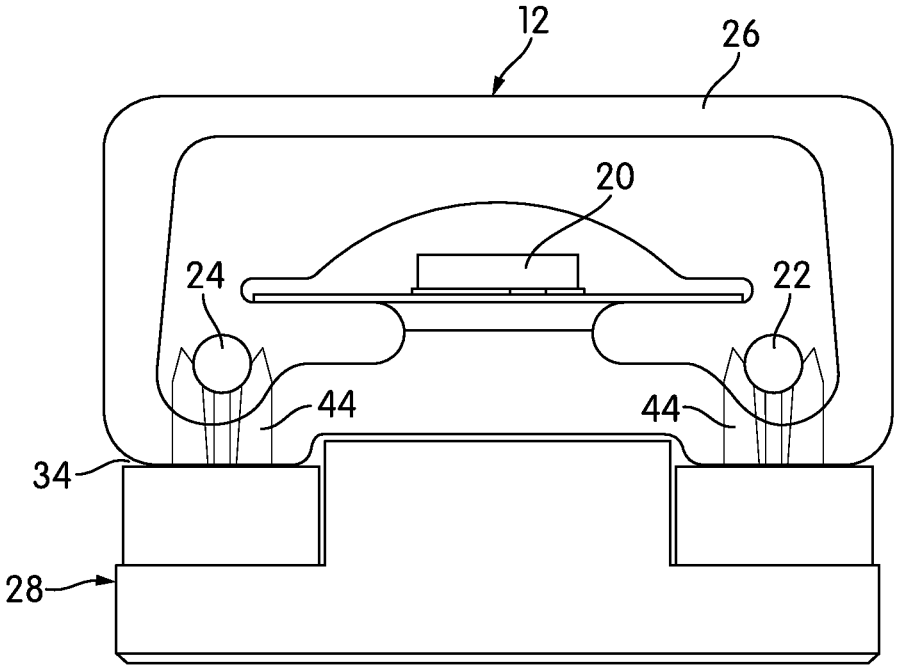
FIG. 3 is a schematic end-elevational view of the strip light installed in the power connector.
Figure 4:
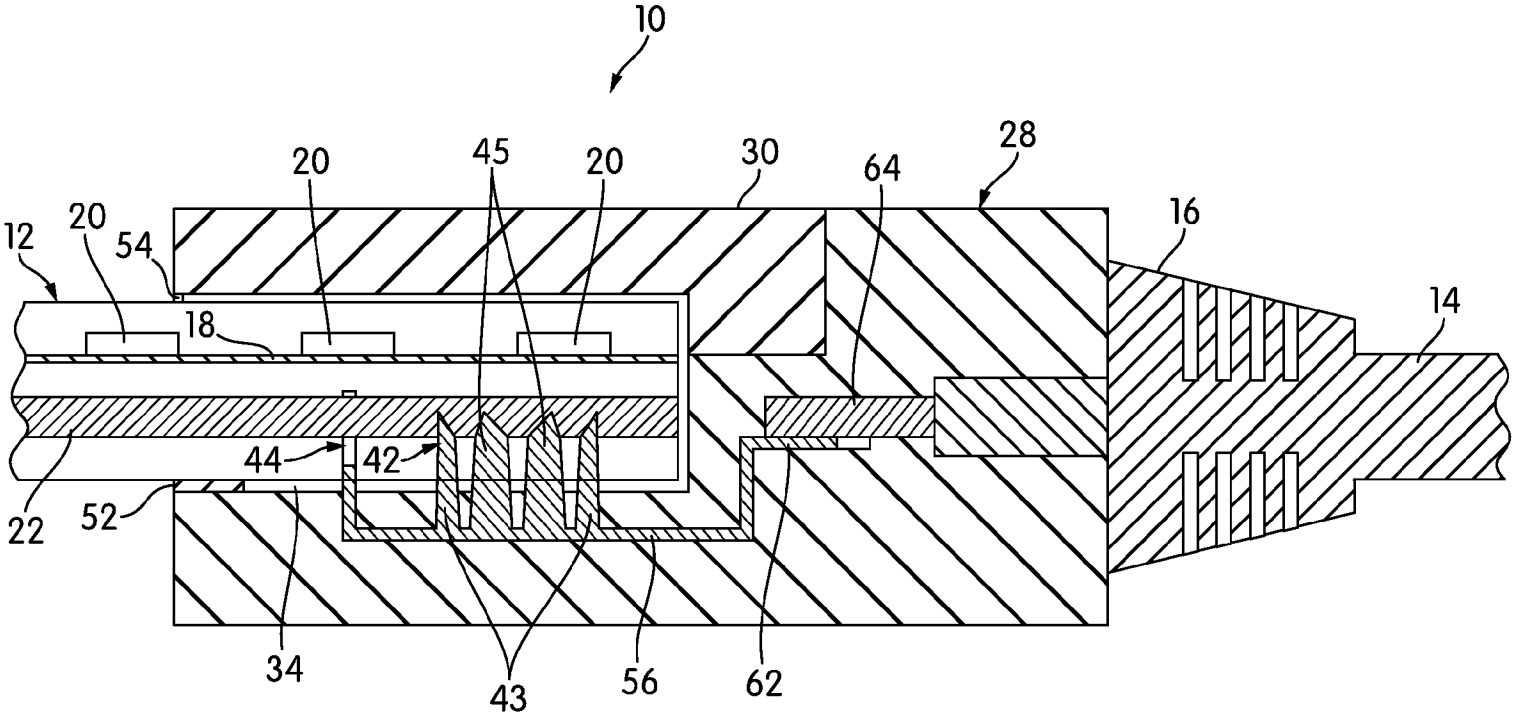
FIG. 4 is a longitudinal cross-sectional view of the power connector with the strip light installed.

As shown in FIGS. 3 and 4, both the longitudinal and transverse pins 42, 44 are positioned to penetrate the insulative covering 26 in order to make contact with the power conductors 22, 24. The individual transverse pins 44 in each pair are spaced from each other with angled side edges that terminate in upper points. The transverse pins 44 also diverge slightly from one another. The side edges and divergence of the pins 44 create a V-shaped space between them, such that they receive and cradle the respective conductors 22, 24 in the transverse plane, as shown in FIG. 3.

Meanwhile, the longitudinal pins 42 penetrate the insulation in alignment with the lengths of the conductors 22, 24, contacting the conductors 22, 24 several times along their lengths. As can be seen in the view of FIG. 4, there are four longitudinal pins 42 in each set. The first and last pins 43 of the set are mirror images of one another and include one vertical long side, one slightly inwardly canted long side, and a single angled edge that connects the two long sides, forming an off-center point. The middle pins 45 of the set are wider than the first and last pins 43 (in the illustrated embodiment, approximately double the width), and are also mirror images of one another. The include two long, vertical sides that are slightly off-vertical, canted toward one another, and a pair of top angled edges that connect between the two long sides, forming an off-center point. The pins 43, 45 reach the same height, but the different shapes provide for different types and degrees of penetration and provide an overall "serrated" edge.

Ideally, both the longitudinal and transverse pins 42, 44 penetrate the insulation 26 sufficiently to make electrical contact, and the amount of contact allows for redundancy and more power-carrying capacity. Additionally, the transverse pins 44, because of the cradling function they provide, may have the effect of holding the conductors 22, 24 in place.

As was described briefly above, the floor of the cavity 34 and the opening 50 include teeth 46, 48, 52 in addition to the sets of pins 42, 44. The general purpose of the teeth 46, 48, 52 is to create enough friction on the covering 26 to hold the strip light 12 in place within the housing 28. In contrast to the pins 42, 44, which would typically be made of a conductive material and adapted to penetrate the insulation 26 fully, the teeth 46, 48, 52 would typically be made of a nonconductive material and either would not be adapted to penetrate the insulation 26 at all, or would be adapted to penetrate only to a very shallow depth to hold the strip light 12 in place. For example, the teeth 46, 48, 52 could be molded features of the housing. Moreover, while the term "teeth" is used, the teeth 46, 48, 52 need not be pointed or particularly sharp; rather, any feature that tends to increase friction on the strip light 12 could be used.

Figure 5:
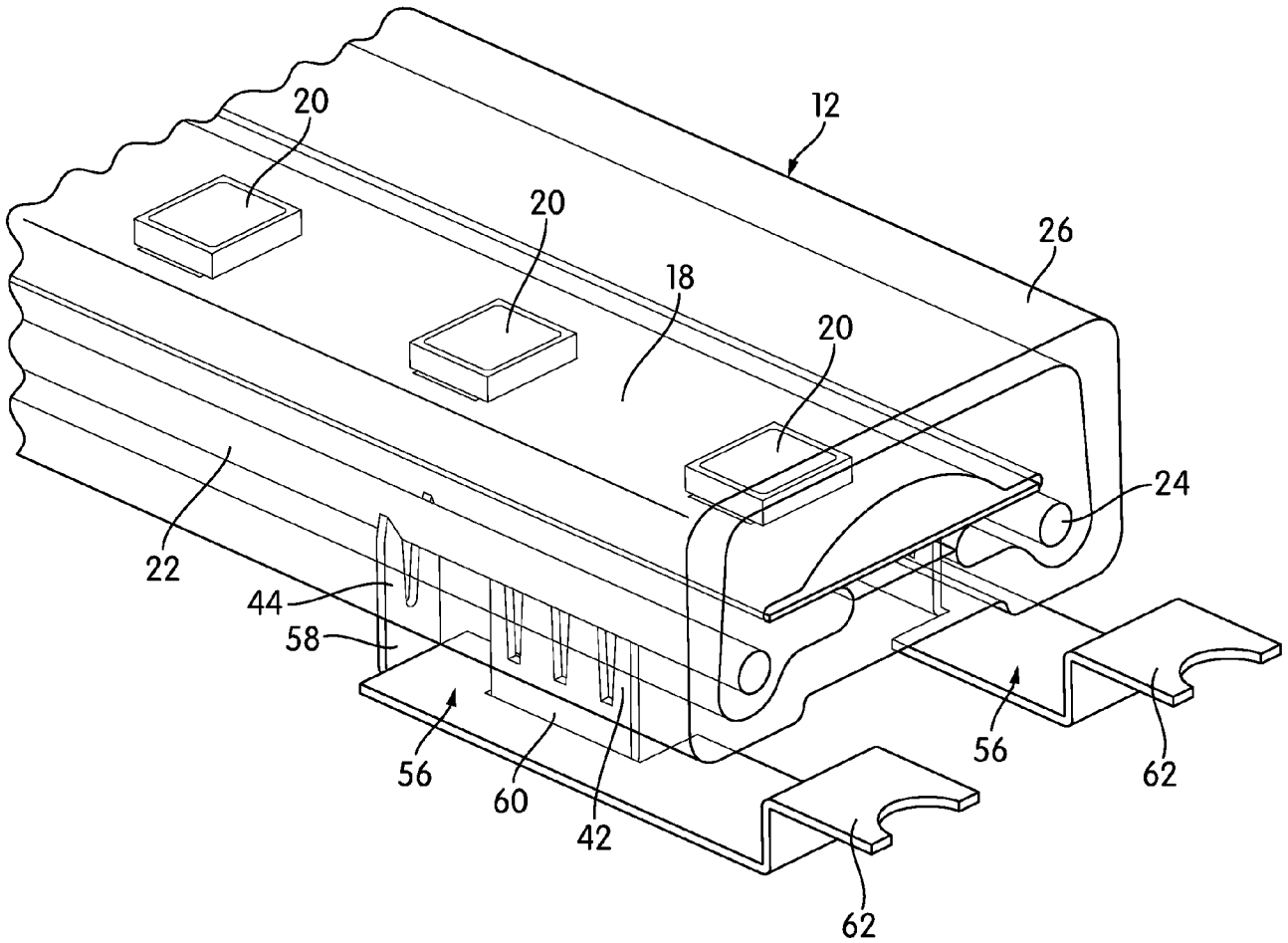
FIG. 5 is a perspective view illustrating the strip light and electrically contacting components of the power connector in isolation.

As shown in FIG. 4, the longitudinal and transverse pins 42, 44 on each side of the cavity 34 are integral parts of a strip conductor 56 that is placed below the floor of the cavity 34. FIG. 5 is a perspective view of one end of the strip light 12, showing its connection with a pair of the strip conductors 56 in isolation. As can be seen in both figures, the pins 42, 44 are actually the divided, pointed ends of a pair of tabs 58, 60 on the strip conductor 56 that are bent to extend upwardly.

At their proximal ends, the two strip conductors 56 take an upward step 62 to contact and connect with respective power and ground conductors 64 from the power cable 14. The connection between the strip conductors 56 and the wires 54 from the power cable 14 may be a soldered connection, a crimped connection, or a connection that relies on any sort of hardware. The upward step 62 allows the cable 14 to align with the horizontal centerline of the housing 28.

In some cases, the housing 28 may be made of a molded plastic, and the strip conductors 56 may be molded into the plastic (e.g., by overmolding). In other cases, the housing and its components may simply be assembled. In either case, final installation of the strip light 12 is relatively simple: the cut or free end of a strip light 12 is placed in the cavity 34 and the removable portion 30 of the housing 28 is placed atop it. Once pressure is exerted, either manually or by tightening of fasteners 56, the pins 42, 44 penetrate the insulation 26 of the strip light 12 and make electrical contact with its conductors 22, 24 at multiple, redundant points, with the transverse pins 44 and teeth 46, 48, 52 helping to hold the conductors 22, 24 in the desired position. This process may be simpler, more repeatable, and more mechanically and electrically robust than a classic process of soldering or making other types of connections with spade connectors or other hardware. Moreover, it can be performed quickly on field-cut lengths of strip light 12. Depending on the gauges of conductors 42, 44, 56 and other factors, the connector 10 may be used with either low-voltage or high-voltage strip light 12, although the strip light 12 enclosed in insulation is more commonly seen with high-voltage strip light.

Of course, the pins 42, 44 need not be part of the same physical structure as long as they are electrically connected together. Thus, the pins 42, 44 may in some cases be individual pins that are connected together with wires, printed circuit board (PCB) contact traces, or any other suitable type of electrical connection.

While the invention has been described with respect to certain embodiments, the description is intended to be exemplary, rather than limiting. Modifications and changes may be made within the scope of the invention, which is defined by the appended claims.

What is claimed is:

1. A connector for a strip light, comprising:
- a housing having
  - a generally rectilinear cavity therein,
  - an opening along at least one face, the opening being contiguous with, and at least about the same width as, the cavity, and
  - a removable cover arranged such that its removal exposes the cavity; and
- a pair of strip conductors mounted within the housing beneath the cavity in positions spaced from one another along the width of the cavity, each of the pair of strip conductors having
  - a first pair of upwardly-extending sharpened pins oriented in a first direction along the width of the cavity, the first pair of pins emerging through a floor of the cavity and diverging from one another to create a space therebetween with a defined width,
  - a second set of upwardly-extending sharpened pins oriented in a second direction along a depth of the cavity, the second direction being essentially orthogonal to the first direction, the second set of pins emerging through the floor of the cavity and being substantially aligned with one another and spaced from one another along the second direction, and
- a connecting portion constructed and arranged to connect to power wires.

2. The connector of claim 1, wherein the connector is adapted such that when assembled with an end of the strip light received within the cavity, the first pair of pins and the second set of pins will penetrate outer insulation of the strip light and make electrical contact with power conductors within the strip light, placing the power conductors in electrical contact with the power wires.

3. The connector of claim 2, further comprising upper and lower seals extending at least around the perimeter of the cavity.

4. The connector of claim 3, wherein the seals comprise silicone gaskets.

5. The connector of claim 2, wherein the housing further comprises a raised wall around at least three sides of the cavity.

6. The connector of claim 2, wherein the removable cover comprises an open or transparent window.

7. The connector of claim 2, wherein the floor of the cavity further includes one or more rows of teeth.

8. The connector of claim 7, wherein the teeth have a height less than the height of the first pair of pins and the second set of pins.

9. The connector of claim 2, wherein first pair of pins and the second set of pins are essentially equal in height above the floor of the cavity.

10. A connector for a strip light, comprising:
- a housing having
  - a generally rectilinear cavity therein,
  - an opening along at least one face, the opening being contiguous with, and at least about the same width as, the cavity, and
  - a removable cover arranged such that its removal exposes the cavity; and
- a set of power conductors and a set of ground conductors spaced from one another along the width of the cavity, each set including
  - a pair of upwardly-extending pins with sharpened upper tips oriented generally parallel to the opening, along the width of the cavity, the pair of pins emerging through a floor of the cavity and diverging from one another to create a generally V-shaped space therebetween with a defined width,
  - a set of upwardly-extending pins with sharpened upper tips proximate to the pair of pins but oriented in a second direction, the second direction being essentially orthogonal to the first direction along a depth of the cavity, the second set of pins emerging through the floor of the cavity and being substantially aligned with one another and spaced from one another along the second direction, and
- a connecting portion constructed and arranged to connect to power wires.

11. The connector of claim 10, wherein the set of power conductors and the set of ground conductors run parallel to and spaced from one another along a long axis of the cavity.

12. The connector of claim 10, wherein the pins of each respective set are electrically connected together.

13. The connector of claim 10, wherein the removable cover has a transparent or translucent window.

14. The connector of claim 10, wherein the pins of each set comprise portions of a single connecting structure that connects the pins mechanically and electrically.

15. The connector of claim 14, wherein the connecting structures are embedded beneath a floor of the cavity.

16. The connector of claim 15, wherein the connecting structures are conductive strips with upturned tabs that are at least partially divided to form the pins.

* * * * *